US012644648B2

(12) United States Patent
Li

(10) Patent No.: US 12,644,648 B2
(45) Date of Patent: Jun. 2, 2026

(54) STEAM HEAT EXCHANGER

(71) Applicant: Yongtang Li, Yantai (CN)

(72) Inventor: Yongtang Li, Yantai (CN)

( * ) Notice: Subject to any disclaimer, the term of this patent is extended or adjusted under 35 U.S.C. 154(b) by 193 days.

(21) Appl. No.: 18/277,782

(22) PCT Filed: Feb. 8, 2022

(86) PCT No.: PCT/CN2022/075432
§ 371 (c)(1),
(2) Date: Aug. 18, 2023

(87) PCT Pub. No.: WO2022/174741
PCT Pub. Date: Aug. 25, 2022

(65) Prior Publication Data

US 2024/0053102 A1 Feb. 15, 2024

(30) Foreign Application Priority Data

Feb. 22, 2021 (CN) ..... 202110196425.4

(51) Int. Cl.
*F28B 1/06* (2006.01)
*F28B 9/08* (2006.01)
*F28F 9/02* (2006.01)

(52) U.S. Cl.
CPC ..... *F28B 1/06* (2013.01); *F28B 9/08* (2013.01); *F28F 9/0204* (2013.01)

(58) Field of Classification Search
CPC ..... F28B 1/06; F28B 9/08; F28F 9/0204
USPC ..... 165/110
See application file for complete search history.

(56) References Cited

U.S. PATENT DOCUMENTS 3,887,002 A * 6/1975 Schoonman ..... F28B 1/06 165/DIG. 197
5,400,853 A 3/1995 Wolters
5,752,566 A * 5/1998 Liu ..... F25B 39/04 165/110
5,765,629 A * 6/1998 Goldsmith ..... F28B 9/10 165/113

(Continued)

FOREIGN PATENT DOCUMENTS

CN 1167248 A 12/1997
CN 104132557 A 11/2014

(Continued)

OTHER PUBLICATIONS

International Search Report of PCT Patent Application No. PCT/CN2022/075432 issued on May 9, 2022.

*Primary Examiner* — Joel M Attey

(57) ABSTRACT

A steam heat exchanger includes a composite header. A first-stage steam inlet header and a second-stage steam inlet header are arranged above the composite header, and the composite header is in communication with the second-stage steam inlet header by means of a transition pipe; and further comprising two groups of heat exchange tubes or heat exchange plates, wherein inlet and outlet ends of a first group of heat exchange tubes or heat exchange plates are respectively connected to the first-stage steam inlet header and the composite header, and inlet and outlet ends of a second group of heat exchange tubes or heat exchange plates are respectively connected to the second-stage steam inlet header and the composite header.

10 Claims, 1 Drawing Sheet

(56) References Cited

U.S. PATENT DOCUMENTS

| | | | | |
|---|---|---|---|---|
| 8,528,358 | B2 * | 9/2013 | Taras | F25B 39/00 62/515 |
| 2022/0205725 | A1 * | 6/2022 | Taras | F28D 1/05391 |
| 2022/0276009 | A1 * | 9/2022 | Cao | F28F 9/0204 |

FOREIGN PATENT DOCUMENTS

| | | | |
|---|---|---|---|
| CN | 210154363 | U | 3/2020 |
| CN | 214384461 | U | 10/2021 |
| DE | 19501547 | A1 | 7/1996 |
| GB | 978067 | A | 12/1964 |

* cited by examiner

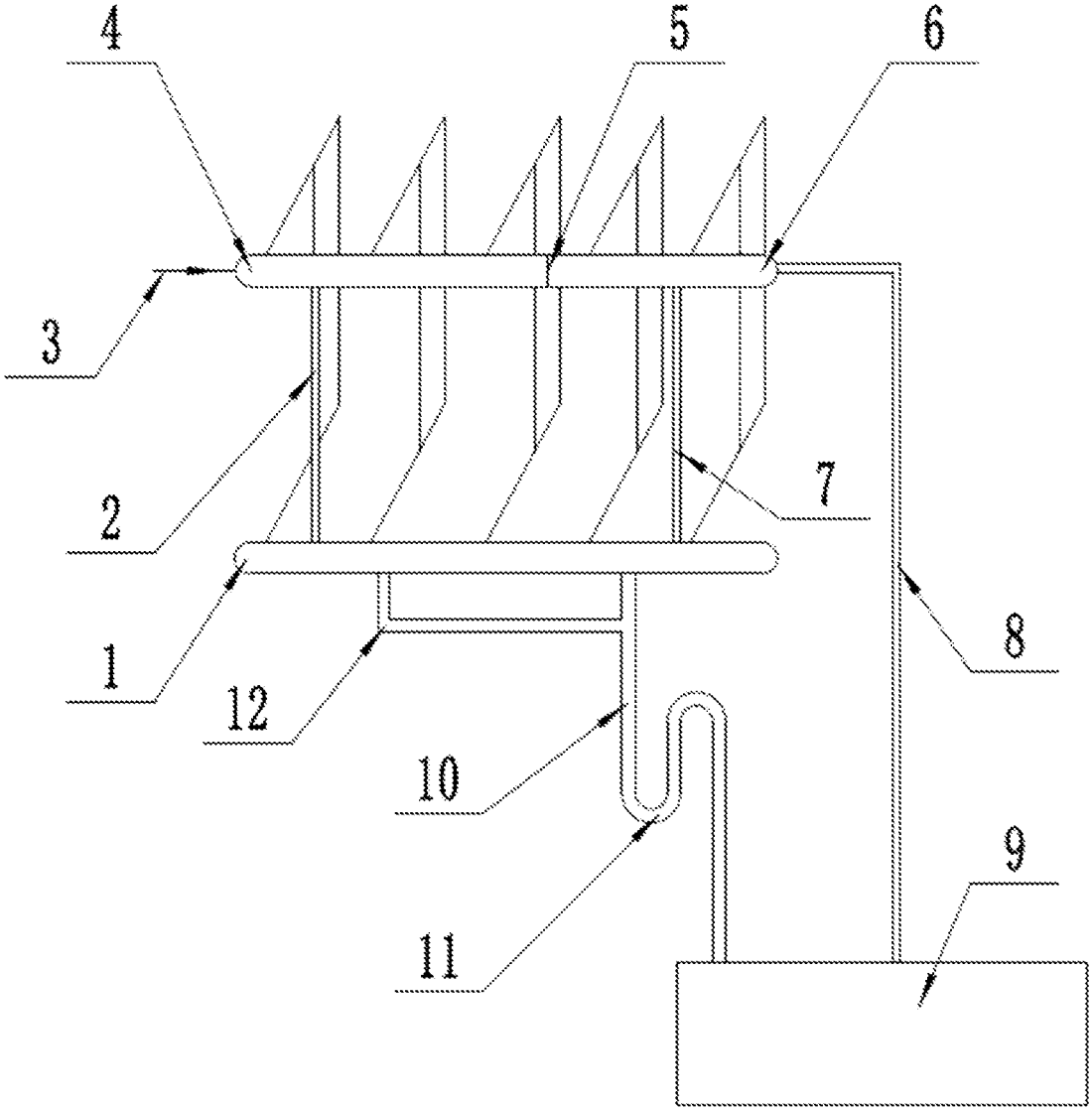
4
5
6
3
2
7
1
8
12
10
9
11

STEAM HEAT EXCHANGER

TECHNICAL FIELD

The present invention relates to a heat exchange device, and particularly to a steam heat exchange device.

BACKGROUND ART

There are two forms of condensation heat transfer of steam in a tube (plate) pass. One is filmwise condensation; and the other is dropwise (droplet) condensation. The dropwise condensation has a surface heat transfer coefficient several times or even an order of magnitude larger than that of the filmwise condensation. Condensation of steam within a horizontal tube (plate) pass is basically a filmwise condensation. During the filmwise condensation, a cooling wall surface is always covered by a liquid film, and phase change heat (latent heat) released during condensation must pass through the liquid film to be transmitted to the wall surface. Therefore, the main disadvantage of the filmwise condensation is that the thermal resistance during condensation is mainly concentrated in a condensation liquid film. In order to improve the heat exchange coefficient of the filmwise condensation, it is necessary to reduce the thickness of the liquid film or create turbulence in a flowing medium.

For heat transfer of the filmwise condensation, in order to improve the heat exchange coefficient and accelerate condensation, the structure form of two or more heat exchangers in series is usually used. For example, Chinese patent application for invention with a publication number of CN 104132557 A discloses "INTERMEDIATE LIQUID DISCHARGE TYPE EFFICIENT CONDENSATION SYSTEM", the system is provided with at least two stages of heat exchangers, wherein a rear end of a heat exchange tube of a front-stage heat exchanger is connected to a front-stage outlet end header, a front end of a heat exchange tube of a rear-stage heat exchanger is connected to a rear-stage inlet end header, and a rear end thereof is connected to a rear-stage outlet end header. The front-stage outlet end header is connected to the rear-stage inlet end header by means of a piping, for introducing gas discharged from the front-stage heat exchanger into the rear-stage heat exchanger. The front-stage heat exchanger and the rear-stage heat exchanger are located in the same box or in different boxes respectively, and a lower end of the box is provided with an air inlet and an upper end thereof is provided with an axial fan. Intermediate liquid discharge is performed at a tail end of the front-stage heat exchanger, and the gas discharged from the front-stage heat exchanger is introduced into the rear-stage heat exchanger, which benefits the flow of a fluid in a heat exchange piping and accelerates the discharge of a liquid film in the heat exchange piping, greatly increasing the heat exchange coefficient. Due to the increase of a steam flow rate along a flow direction of the liquid film, it would create turbulence in the liquid film, and it would also cause the liquid film to be blown off the wall surface, thereby increasing the heat exchange coefficient. This kind of structure mainly has the following two defects. First, a heat exchange device occupies a large area, and there are many connecting pipings including headers, with a high complexity in processing, and also with a need to be connected to a pipeline during assembly, which requires a secondary anti-corrosion process and increases installation difficulty. Second, from the perspective of the effect of the intermediate liquid discharge, the effect of this type of structure is still unsatisfactory, mainly reflected in: a liquid outlet header of the previous stage and a liquid outlet header of the next stage are independent of each other, there is a certain pressure drop between the two, and since the liquid outlet header of the previous stage contains a mixture of gas phase steam and liquid phase steam, it is difficult to separate them during flowing. In addition, since a steam inlet header of the next stage and a discharge header of the previous stage are in communication with each other, and their respective liquid outlet pipes directly discharge, under the action of a pressure drop, some foamy liquid flows into the steam inlet header of the next stage. It affects the heat transfer effect of the heat exchanger of the next stage.

SUMMARY OF THE INVENTION

Technical Problems

The technical problem to be solved by the present invention is to provide a steam heat exchanger, which reduces the thickness of a liquid film and improves the heat exchange efficiency, and also greatly simplifies a piping structure comprising headers, so that an occupied area is less and the processing and assembly are more convenient, so as to overcome the shortcomings in the prior art.

Solutions to the Problems

Technical Solutions

The technical solution of the present invention is as follows:

a steam heat exchanger, characterized by comprising a composite header with a liquid discharge pipe, wherein a first-stage steam inlet header and a second-stage steam inlet header are arranged above the composite header, the first-stage steam inlet header is provided with a steam inlet pipeline, and the composite header and the second-stage steam inlet header are in communication with each other by means of a transition pipe; and further comprising two groups of heat exchange tubes or heat exchange plates, wherein inlet and outlet ends of a first group of heat exchange tubes or heat exchange plates are respectively connected to the first-stage steam inlet header and the composite header, and inlet and outlet ends of a second group of heat exchange tubes or heat exchange plates are respectively connected to the second-stage steam inlet header and the composite header.

Preferably, if the heat exchange tube or heat exchange plate is selected as a heat exchange tube, the heat exchange tube is a coiled tube or a multistage U-shaped tube.

Preferably, the steam heat exchanger further comprises a bypass pipe, an upper end of which is in communication with a lower side portion of the first-stage steam inlet header, and a lower end of which is in communication with the composite header, for introducing a liquid phase fluid in the first-stage steam inlet header into the composite header.

Further preferably, the bypass pipe is a straight pipe or a pipe with a liquid seal.

Preferably, the liquid discharge pipe is connected to a liquid reservoir, and a balance pipe is connected between the second-stage steam inlet header and the liquid reservoir.

Preferably, the steam heat exchanger further comprises an auxiliary liquid discharge pipe for communicating the composite header with the liquid discharge pipe, wherein a communication point between the auxiliary liquid discharge pipe and the liquid discharge pipe is closer to a high pressure end of the composite header than a communication point between the liquid discharge pipe and the composite header.

Preferably, the first-stage steam inlet header and the second-stage steam inlet header are two header sections of the same header separated by providing a partition plate inside.

Beneficial Effects of the Invention

Beneficial Effects

The positive effects of the present invention are as follows.

First, a composite header of the present invention has the most important function of balancing a pressure difference between a first liquid outlet end and a second liquid outlet end, thus greatly improving a gas-liquid separation effect of the first liquid outlet end. The efficiency of a second group of heat exchangers is improved. In addition, due to a pressure drop between a first-stage steam inlet header and a second-stage steam inlet header of the present invention, a flow speed of the gas phase steam in the system is increased, so that the discharge of a condensation liquid film is accelerated, the thickness of the condensation liquid film is reduced, and turbulence in fluid in the system is caused more easily, thus improving the heat exchange efficiency.

Second, the whole system uses at most three headers, in particular, one header can be divided into two sections to replace two headers. The device has the outstanding characteristics of a compact structure and a small occupied area, and can complete anti-corrosion treatment at one time as a whole, reducing the pipeline connection and installation and a secondary anti-corrosion operation at a user end.

Third, the pressure in the first-stage steam inlet header is greater than that in the second-stage steam inlet header. A balance pipe connected to a liquid reservoir is connected to the second-stage steam inlet header, which can effectively reduce an internal pressure of the liquid reservoir, thereby facilitating liquid return of a condensation system, and can effectively reduce the temperature of a medium in the liquid reservoir, thereby reducing a cooling workload for the liquid reservoir.

Fifth, in a solution of additionally providing an auxiliary liquid discharge pipe, a liquid discharge pipe can be connected to a low pressure end of the composite header for discharging main liquid phase steam, and the auxiliary liquid discharge pipe can be connected to a high pressure end of the composite header for discharging part of the liquid phase steam in advance to reduce a load of the subsequent (the second group of heat exchange tubes or heat exchange plates).

Sixth, in a solution of additionally providing a bypass pipe, a condensation liquid and oil in the first-stage steam inlet header are introduced into the composite header in advance through the bypass pipe, thus effectively reducing the effect of an oil film and a liquid film and further improving the heat exchange efficiency.

BRIEF DESCRIPTION OF THE DRAWINGS

Description of the Drawings

FIG. 1 is a schematic structural diagram of an embodiment of the present invention.

EMBODIMENTS OF THE INVENTION

Implementations of the Invention

The present invention will be further described below with reference to an embodiment and an accompanying drawing thereof.

As shown in FIG. 1, an embodiment of the present invention comprises a composite header 1, and a first-stage steam inlet header 4 and a second-stage steam inlet header 6 are arranged above the composite header 1. The first-stage steam inlet header 4 is provided with a steam inlet pipeline 3. As an optimized solution, the first-stage steam inlet header 4 and the second-stage steam inlet header 6 are two header sections of the same header separated by providing a partition plate 5 inside. The composite header 1 and the second-stage steam inlet header 6 are in communication with each other by means of a transition pipe 7. Two groups of heat exchange tubes or heat exchange plates are further provided, wherein inlet and outlet ends of a first group of heat exchange tubes or heat exchange plates are respectively connected to the first-stage steam inlet header 4 and the composite header 1, and inlet and outlet ends of a second group of heat exchange tubes or heat exchange plates are respectively connected to the second-stage steam inlet header 6 and the composite header 1. The composite header 1 is provided with a liquid discharge pipe 10, and the liquid discharge pipe 10 is connected to a liquid reservoir 9 by means of a liquid seal elbow 11.

If the heat exchange tube or heat exchange plate is selected as a heat exchange tube, the heat exchange tube is a coiled tube or a multistage U-shaped tube.

In order to introduce a liquid phase fluid (mainly a condensation liquid and oil) in the first-stage steam inlet header 4 into the composite header 1, so as to reduce the effect of an oil film and a liquid film on the heat exchange efficiency, an embodiment of the present invention further comprises a bypass pipe 2, an upper end of which is in communication with a lower side portion of the first-stage steam inlet header 4, and a lower end of which is in communication with the composite header 1.

The bypass pipe is preferably a straight pipe or a pipe with a liquid seal.

An embodiment of the present invention further comprises a balance pipe 8 for communicating the second-stage steam inlet header 6 with the liquid reservoir 9.

An embodiment of the present invention further comprises an auxiliary liquid discharge pipe 12 for communicating the composite header 1 with the liquid discharge pipe 10, and a communication point between the auxiliary liquid discharge pipe 12 and the liquid discharge pipe 10 is generally located at a high pressure end of the composite header 1.

A communication point between the liquid discharge pipe 10 and the composite header 1 is generally located at a low pressure end of the composite header 1.

When in use, the headers, heat exchange tubes or heat exchange plates and related connecting pipings are all placed in a housing, and steam in a system is condensed by evaporative heat dissipation of sprayed water or cold air. High temperature and high pressure steam enters from the steam inlet pipeline 3 at the left end of the first-stage steam inlet header 4, exchanges heat with the sprayed water or cold air in the housing by means of the first group of heat exchange tubes or heat exchange plates, and enters the composite header 1 after the steam is partially condensed, and then the liquid phase steam is discharged into the liquid reservoir 9 through the liquid discharge pipe 10 and the auxiliary liquid discharge pipe 12, while the gas phase steam enters the second group of heat exchange tubes or heat exchange plates through the transition pipe 7 and the second-stage steam inlet header 6, exchanges heat with the sprayed water or cold air in the housing, enters the composite header 1 after condensed, and then is discharged into the liquid reservoir 9 through the liquid discharge pipe 10 and the auxiliary liquid discharge pipe 12.

The invention claimed is:

1. A steam heat exchanger, characterized by comprising a composite header (1) with a liquid discharge pipe (10), wherein a first-stage steam inlet header (4) and a second-stage steam inlet header (6) are arranged above the composite header (1), the first-stage steam inlet header (4) is provided with a steam inlet pipeline (3), and the composite header (1) and the second-stage steam inlet header (6) are in communication with each other by means of a transition pipe (7); and further comprising two groups of heat exchange tubes or heat exchange plates, wherein inlet and outlet ends of a first group of heat exchange tubes or heat exchange plates are respectively connected to the first-stage steam inlet header (4) and the composite header (1), and inlet ends of a second group of heat exchange tubes or heat exchange plates are connected to the second-stage steam inlet header (6) and outlet ends of the second group of heat exchange tubes or heat exchange plates are directly connected to the composite header (1);

wherein the liquid discharge pipe (10) is connected to a liquid reservoir (9), and a balance pipe (8) is connected between the second-stage steam inlet header (6) and the liquid reservoir (9).

2. The steam heat exchanger of claim 1, characterized in that if the heat exchange tube or heat exchange plate is selected as a heat exchange tube, the heat exchange tube is a coiled tube or a multistage U-shaped tube.

3. The steam heat exchanger of claim 1, characterized by further comprising a bypass pipe (2), an upper end of which is in communication with a lower side portion of the first-stage steam inlet header (4), and a lower end of which is in communication with the composite header (1), for introducing a liquid phase fluid in the first-stage steam inlet header (4) into the composite header (1).

4. The steam heat exchanger of claim 3, characterized in that the bypass pipe (2) is preferably a straight pipe or a pipe with a liquid seal.

5. The steam heat exchanger of claim 1, characterized by further comprising an auxiliary liquid discharge pipe (12) for communicating the composite header (1) with the liquid discharge pipe (10), wherein a communication point between the auxiliary liquid discharge pipe (12) and the liquid discharge pipe (10) is closer to a high pressure end of the composite header (1) than a communication point between the liquid discharge pipe (10) and the composite header (1).

6. The steam heat exchanger of claim 1, characterized in that the first-stage steam inlet header (4) and the second-stage steam inlet header (6) are two header sections of the same header separated by providing a partition plate (5) inside.

7. The steam heat exchanger of claim 2, characterized in that the first-stage steam inlet header (4) and the second-stage steam inlet header (6) are two header sections of the same header separated by providing a partition plate (5) inside.

8. The steam heat exchanger of claim 3, characterized in that the first-stage steam inlet header (4) and the second-stage steam inlet header (6) are two header sections of the same header separated by providing a partition plate (5) inside.

9. The steam heat exchanger of claim 4, characterized in that the first-stage steam inlet header (4) and the second-stage steam inlet header (6) are two header sections of the same header separated by providing a partition plate (5) inside.

10. The steam heat exchanger of claim 5, characterized in that the first-stage steam inlet header (4) and the second-stage steam inlet header (6) are two header sections of the same header separated by providing a partition plate (5) inside.

* * * * *